US006869322B1

(12) United States Patent
Reinemuth et al.

(10) Patent No.: US 6,869,322 B1
(45) Date of Patent: Mar. 22, 2005

(54) METHOD OF PRODUCING AN ELECTRICALLY CONDUCTIVE CONNECTION BETWEEN METALLIC COMPONENTS HAVING A NON-CONDUCTIVE COATING

(75) Inventors: Jürgen Reinemuth, Weinheim (DE); Peter Gatz, Oftersheim (DE); Michael Theilig, Schwetzingen (DE)

(73) Assignee: Pfaudler, Inc., Rochester, NY (US)

( * ) Notice: Subject to any disclaimer, the term of this patent is extended or adjusted under 35 U.S.C. 154(b) by 17 days.

(21) Appl. No.: 10/375,779

(22) Filed: Feb. 27, 2003

(30) Foreign Application Priority Data

Feb. 27, 2002 (EP) ..... 02004552

(51) Int. Cl.[7] ..... H01R 9/24; H01R 13/02
(52) U.S. Cl. ..... 439/886; 439/931; 29/845
(58) Field of Search ..... 439/886, 931; 29/845, 447, 830

(56) References Cited

U.S. PATENT DOCUMENTS 4,152,540 A * 5/1979 Duncan et al. ..... 174/152 GM
4,964,788 A * 10/1990 Itameri-Kinter et al. .... 417/422
4,984,927 A * 1/1991 Kojima et al. ..... 403/30
4,984,973 A * 1/1991 Itameri-Kinter et al. .... 417/422
5,318,756 A * 6/1994 Sheller et al. ..... 422/174

FOREIGN PATENT DOCUMENTS

| | | |
|---|---|---|
| DE | 44 20 570 | 10/1995 |
| EP | 0 189 992 | 8/1986 |
| EP | 0 470 718 | 2/1992 |
| EP | 0 495 133 | 7/1992 |

* cited by examiner

*Primary Examiner*—Michael C. Zarroli
(74) *Attorney, Agent, or Firm*—Michael L. Dunn

(57) ABSTRACT

A method is provided for producing an electrically conductive connection between metallic components (2, 6), such as an agitator blade assembly (6) and a drive shaft (2) which have a non-conductive coating (7). In the method an at least partially electrically conductive pasty medium (8) is located in a pocket (12) between the components (2, 6) in contact with metallic portions (9, 10) of the components (2, 6) which are substantially free of any non-conductive coating (7). The connection between the components (2, 6) themselves provide a protection against the pasty medium (8) being accidentally removed from the region in use. For example, the components (2, 6) may be shrink-fitted together to form the connection with the pasty medium (8) located within the area of contact between the components (2, 6) and surrounded by interference fitted contact areas (11) between the components (2, 6) to provide the protection for the pasty medium (8). The pasty medium (8) preferably comprises a chemically universal non-corroding material made from a mixture including graphite.

28 Claims, 4 Drawing Sheets

PRIOR ART

METHOD OF PRODUCING AN ELECTRICALLY CONDUCTIVE CONNECTION BETWEEN METALLIC COMPONENTS HAVING A NON-CONDUCTIVE COATING

BACKGROUND OF THE INVENTION

The present invention relates to a method of producing an electrically conductive connection between metallic components which have a non-conductive coating. In particular, the invention relates to a method of producing an electrically conductive coating between the metallic components which are coated with an enamel, glass or similar coating that is resistant to corrosive media.

In the chemical and pharmaceutical industries, it is common for agitators to be used in corrosive environments. In such cases, the agitator blades and the agitator shaft to which the blades are connected are usually coated with materials such as enamel or glass, which are stable in such environments and can withstand attack by such media. It is normal for both the agitator shaft and the agitator blades to be completely coated by the stable medium so that they only contact one another by way of the medium, which typically is not electrically conductive.

EP 0 189 992 describes an agitator assembly wherein the exterior surfaces of agitator blades as well as the exterior surface of a drive shaft for the agitator blades are coated with glass and a hub of the agitator blade assembly is interference fitted to the drive shaft in glass-to-glass surface contact sufficient to withstand torque imparted to the blades by the drive shaft. The shrink-fitting of agitator blades to a drive shaft in this way has been shown to be impermeable to liquids and is therefore liquid-tight, it having been verified that liquid particles penetrate the joint only to a small extent in a region at the periphery of blade hub/drive shaft connection area.

However, it will be appreciated that in such an assembly there is no electrical connection between the agitator blades and the drive shaft. The lack of any electrical connection between the agitator blades and the drive shaft means that the agitator cannot be electrically grounded. Regulations now require that within certain vessels used in chemical and pharmaceutical processes all components must be grounded to prevent electrostatic charges building up.

Also, the lack of any electrical connection between the agitator blades and the drive shaft means that known methods of monitoring the state of the enamel coating the blades cannot be used. In such a method, electrical means for detecting damage would be connected between an electrode extending into, for example, a conductive liquid contained in the vessel and an external conductor connected to the drive shaft. When enamel damage occurs, the conductive liquid would come into direct contact with the metal of the agitator blades, thus closing the electrical circuit to actuate an alarm. If an electrical connection is required, it is currently necessary to provide metallic rings around the blade hub which can contact a metallic area of the agitator shaft, both of which metallic areas must be made from chemically stable material. These rings are typically made from corrosion-resistant steel and are welded in the interior of a blade hub and the shaft of an agitator assembly. It is critical, however, that the rings are sealed with respect to the adjoining enamel coating to prevent corrosive attack on the underlying metal. This is a potential source of damage to the enamel coating. As a result of these requirements and the fact that only chemically stable metals can be used, this method is very costly. Also, it is not possible to upgrade an existing agitator assembly to apply it. In an alternative approach, chemically stable screws, wires and cables can be used to conjoin components together but this in itself can be a cause of considerable damage to the enamel or other non-conductive coating. Also, both of these methods can: lead to a high contact resistance existing between the two components which is not always desirable.

The known insulating connection method does have one significant advantage. When products are being agitated they tend to charge electrostatically; thus there is always a risk that electrostatic discharges can lead to a puncture of the enamel with consequent damage to the metal of the agitator. The tendency for electrostatically caused punctures to occur is greatest in those places where the relative speed between the product and the agitator is at its greatest, which means that such punctures usually occur on the tips of the agitator blades. The risk of such punctures occurring is directly related to the high electrical charging potential difference between an electrostatically charged product and the agitator. If mixing is carried out using a non-grounded agitator, then the agitator itself builds up an opposite charge to that of the product, which then reduces the potential difference between it and the product. As a result electrostatically caused punctures are less likely to occur.

The object of the present invention is to provide a method of producing an electrically conductive connection between the metallic components that have a non-conductive coating, which overcomes the aforementioned disadvantages.

BRIEF SUMMARY OF THE INVENTION

According to a first aspect of the present invention there is provided a method of producing an electrically conductive connection between metallic components which have a non-conductive coating characterized in that an at least partially electrically conductive pasty medium is located in a region between the components in contact with metallic portions of the components which are substantially free of any non-conductive coating, the connection itself providing a protection against the pasty medium being accidentally removable from the region in use.

In accordance with the invention, the method preferably comprises the steps of:

- coating at least two metallic components which are to be shrink-fitted together with an electrically non-conductive coating;
- treating the surface of at least one of the components in a region which will lie within an area of contact between the components when the two are shrink-fitted together to provide a pocket and to provide a portion within the pocket which is substantially free of the non-conductive coating;
- providing a portion on the other of the components which is substantially free of the non-conductive coating in a region which will lie apposed to the pocket when the components have been shrink-fitted together;
- filling the pocket with the pasty medium;
- smoothing the surface of the pasty medium; and
- shrink-fitting the components together.

According to a second aspect of the present invention there is provided an at least partially electrically conductive pasty medium for use in the method according to the first aspect of the present invention.

According to a third aspect of the present invention there is provided an electrically conductive connection between metallic components which have a non-conductive coating characterized in that an at least partially electrically conductive pasty medium is located in a region between the components in contact with metallic portions of the components which are substantially free of any non-conductive coating, the connection itself providing a protection against the pasty medium being accidentally removable from the region.

According to a fourth aspect of the present invention there is provided an agitator assembly comprising at least two metallic components which have a non-conductive coating, characterized in that an at least partially electrically conductive pasty medium is located in a region between a drive shaft and a hub of a blade assembly of the agitator assembly in contact with metallic portions of the drive shaft and the hub which are substantially free of any non-conductive coating, the connection itself providing a protection against the pasty medium being accidentally removed from the region in use.

BRIEF DESCRIPTION OF THE DRAWINGS

The present invention will now be described by way of example with reference to the accompanying drawings, in which.

DETAILED DESCRIPTION OF THE INVENTION

Figure 1:
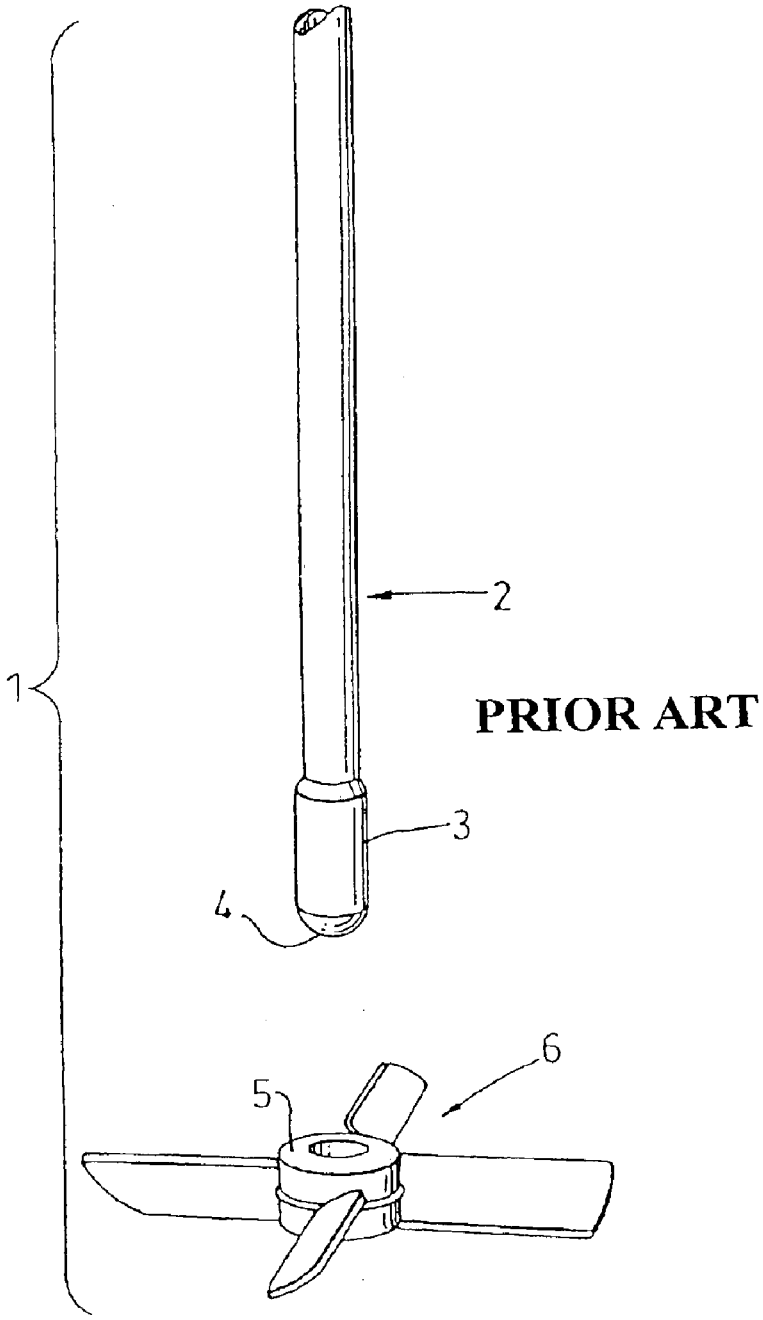
FIG. 1 is a perspective view of a prior art agitator assembly prior to the shrink-fitment of an agitator blade assembly to a drive shaft.

It will be appreciated that the use of a pasty medium to form the electrical connection between the two components has several advantages over the prior art. First, the pasty medium is deformable and cannot damage the non-conductive coating when located between the components. Second, it seals the portions of the components which are substantially free of any non-conductive coating as well as providing an electrical connection between them. Hence, the pasty medium itself acts to reduce corrosion occurring within the joint between the components.

Preferably, the components are shrink-fitted together to form the connection, the pasty medium being located within the area of contact between the components and surrounded by interference fitted contact areas between the components to provide the protection for the pasty medium.

In accordance with a preferred embodiment of the invention, prior to the shrink-fitment of the components with one another, at least one of them has been provided with a pocket in which a volume of the pasty medium can be retained and within which the metallic portion that is substantially free of the non-conductive coating is located.

Advantageously, the surface area of the pocket is large in comparison to the surface area of the metallic portion of the component located therein. Preferably also, the surface area of the pocket opening as presented to the other component is large in comparison to the surface area of the metallic portion of the other component. In this way, the metallic portions of the components can be located away from the edges of the pasty medium and therefore protected from attack by any corrosive medium which may penetrate the joint between the components.

Desirably, complementary pockets are provided in the components in regions which will lie apposed to one another when the components have been shrink-fitted together and the pasty medium completely fills the volume of the pocket or pockets provided between the components.

Alternatively, at least one of the components comprises a groove, at least part of the surface of which groove is substantially free of any non-conductive coating to form the metallic portion of the component, the bottom of the groove being filled with the pasty medium so that the metallic portion is completely covered by the pasty medium and sufficient pasty medium is used to fill the groove that penetration of an exterior medium into the shrink-fitted joint is substantially prevented.

Preferably, the method further comprises the additional steps of treating the surfaces of both of the components in regions which will lie apposed to one another when the two are shrink-fitted together to provide a pocket in each component, and filling both pockets with the pasty medium prior to the shrink-fitment of the components together.

Preferably also, the surface of the pasty medium in the pocket or pockets is smoothed so as to stand lightly proud of the adjacent surfaces of the component.

The pasty medium desirably comprises a chemically universal non-corroding material that may include one or more food grade materials and comprises an electrically conductive material that is preferably graphite.

Advantageously, the ratio of graphite or other conductive material to other materials of the medium is varied to achieve a desired conductivity of the medium.

The pasty medium may also comprise proprietary materials for identification purposes.

The pasty medium desirably has a viscosity which remains substantially constant over a temperature range between −90° C. and 300° C. inclusive and has sufficient form stability to be plastically deformable in the aforementioned temperature range. The pasty medium is essentially impermeable to fluids with which it may be contacted.

The pasty medium also preferably has a coefficient of thermal expansion which is comparable with that of the components between which it is to be located.

Figure 2:
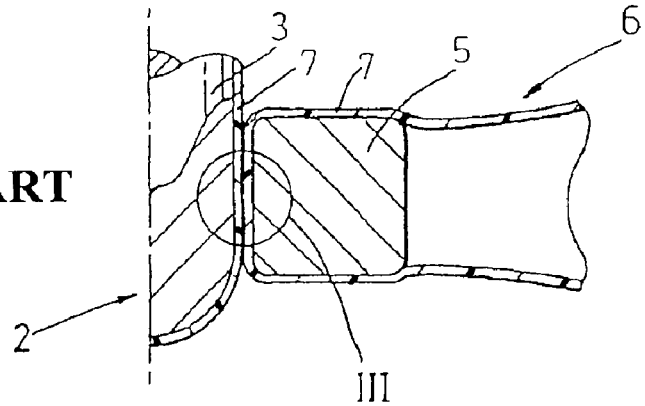
FIG. 2 is a cross-sectional view to an enlarged scale, through an agitator blade assembly and drive shaft as shown in FIG. 1 when connected together by a shrink-fit connection.
Figure 3:
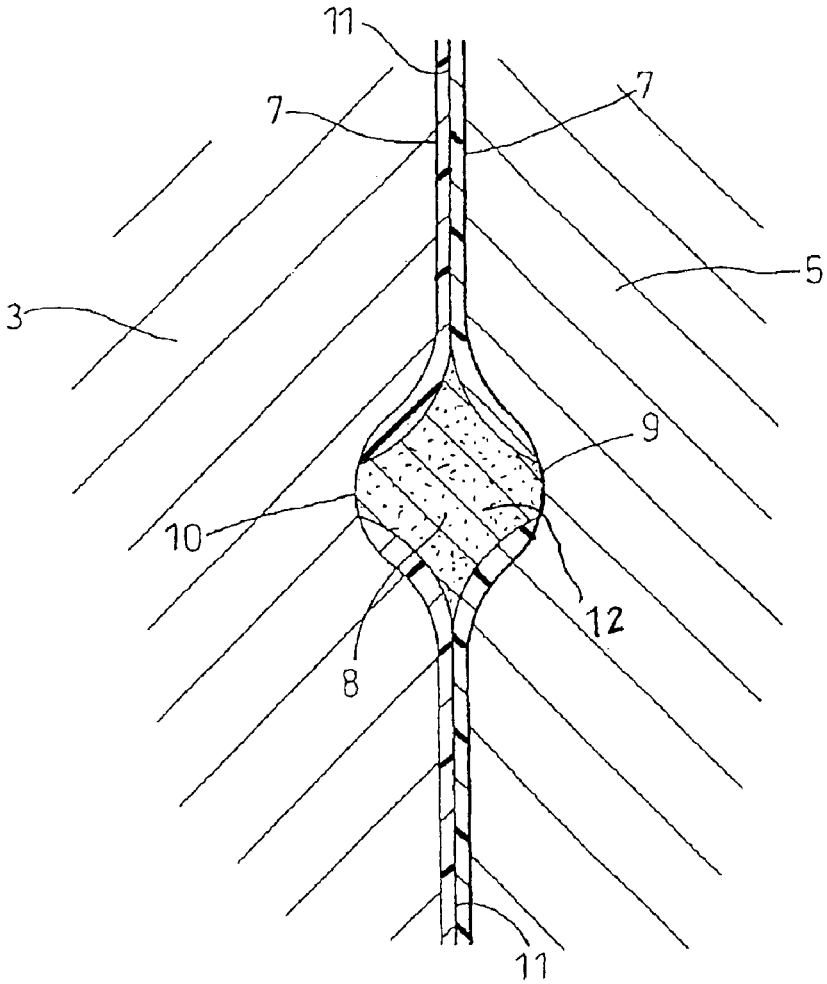
FIG. 3 is a view to a considerably increased scale of the ringed area marked III in FIG. 2 additionally showing a method of connection according to the present invention.

With reference to FIG. 1, an agitator assembly 1 comprises a drive shaft 2 with an enlarged end section 3 and closed end 4 for fitment into a hub 5 of an agitator blade assembly 6. As shown in FIG. 2, the whole of the exterior surfaces of the drive shaft 2 and the agitator blade assembly 6 are coated with a layer of enamel or glass 7, the glass being bonded thereto by conventional practice well known to those with skill in the art. The agitator assembly is then assembled by the shrink-fitment of the agitator blade assembly 6 to the enlarged end section 3 of the drive shaft, again in accordance with conventional practice. Hence, as indicated in FIG. 2, there exists two electrically non-conductive enamel or glass layers 7 between the agitator blade assembly 6 and the drive shaft 2 so that the latter are not in electrical contact with one another.

In accordance with the present invention, in order to ensure that the agitator blade assembly 6 and the drive shaft 2 are placed in electrical contact, an electrically conductive pasty medium 8 is located in a region between the assembly 6 and the drive shaft 2 in contact with portions 9 and 10 respectively of the assembly 6 and the drive shaft 2 which are substantially free of the enamel or glass coating 7.

The pasty medium 8 is located away from the edges of the shrink-fit connection and well within the area of contact between the assembly 6 and the drive shaft 2, surrounded by interference fitted contact areas 11 between these components, to prevent the pasty medium 8 being washed out of or otherwise accidentally removed from the agitator assembly when it is in use. The shrink-fit connection itself thereby provides the necessary protection for the pasty medium 8.

As it is necessary to for the pasty medium 8 to be in electrical contact with the underlying metal of the assembly 6 and the drive shaft 2, the two components 2, 6 are either ground prior to their shrink-fitment to remove the enamel or glass coating 7 in areas which will lie apposed to one another when they have been shrink-fitted together, or they are treated to ensure that the appropriate portions 9 and 10 comprise blank metal that has been left free of the non-conductive coating 7. In the latter case, it may be necessary to remove scale to produce bare metal portions 9 and 10 that will ensure a good electrical connection. In addition, preferably at least one of the two components 2, 6, and advantageously both of them, is ground or otherwise treated to provide a pocket 12 in which the bare metallic portion 9 or 10 that is substantially free of the non-conductive coating 7 is formed and in which a volume of the pasty medium 8 can be retained.

Preferably, the surface area of the pocket 12 is large in comparison to the surface area of the metallic portion 9 or 10 located therein. Also, the surface area of the pocket opening in one component as presented to the other component should also be large in comparison to the surface area of the metallic portion 9 or 10 of that other component. In this way, the bare metallic portions 9 and 10 can be located well away from the periphery of the shrink-fitted joint and therefore protected from any external media which may penetrate the joint during use of the assembly.

Figure 5:
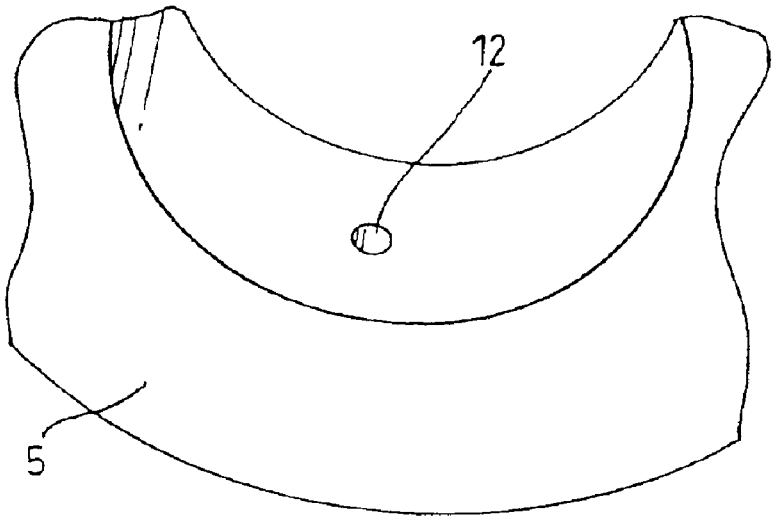
FIG. 5 is a perspective view of the interior of an agitator blade hub modified in accordance with the present invention and for fitment to the drive shaft shown in FIG. 6.
Figure 6:
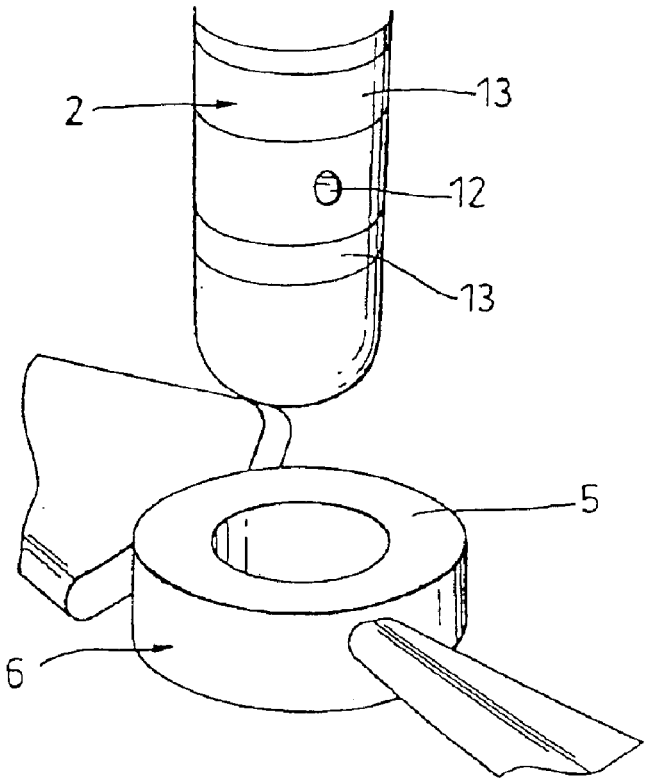
FIG. 6 is a view similar to FIG. 1 but showing a drive shaft modified in accordance with the present invention.

The pocket or pockets 12 are preferably circular with a diameter of approximately 5–6 mm. The pocket 12 in the blade assembly 6 is located centrally of the hub 5 and that in the drive shaft 2 is located in a pocket/region 12 which will lie adjacent thereto when the assembly 6 has been shrink-fitted onto the drive shaft 2, as shown in FIGS. 5 and 6. Preferably, as shown in FIGS. 4 and 6 the drive shaft 2 is marked by bands or up-raised portions 13 between which the hub 5 is fitted in order to ensure an optimal overlapping of the pockets 12.

Once the pockets 12 have been ground out, they are both completely filled with the pasty medium and the surfaces of the medium smoothed to stand lightly proud of the adjacent surfaces of the hub 5 and the drive shaft 2. The two components can then be shrink-fitted in a conventional manner.

Figure 4:
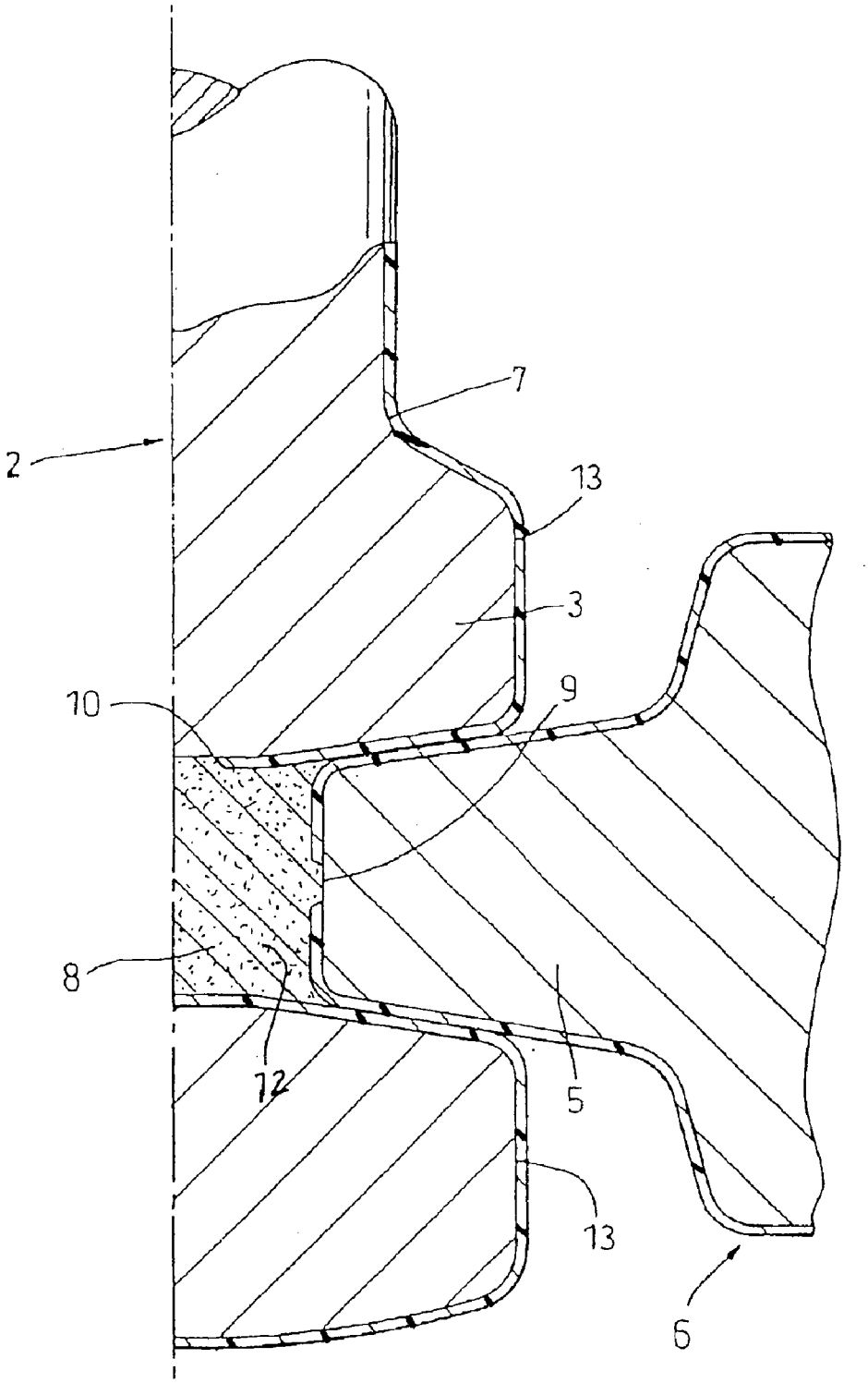
FIG. 4 is a view similar to that of FIG. 2, but to an increased scale, and showing a variation in the method of connection in accordance with the present invention.

FIG. 4 also shows how a pocket 12 in a component such as a drive shaft 2 can be made by providing around the shaft 2 a deep enameled part-conical groove, part of the base of which is either left free from enamel or has had the enamel removed therefrom to provide the bare metallic portion 10. The bottom of the groove is then completely filled with the pasty medium 8 prior to the shrink fitting of the blade assembly 6 thereto in the region between the bands 13. In this way, during use of the agitator assembly, a corrosive medium being mixed by the assembly cannot penetrate sufficiently into the shrink-fitted joint to reach the bare metallic areas 9 and 10 because the pasty medium prevents this from occurring.

Also, it is often the case in use of an agitator assembly such as is shown in FIG. 4 that the mixing container in which the assembly is located is subject to a positive or negative pressure (vacuum). As the shrink-fitted joint is not pressure-tight, the medium being mixed often penetrates the joint and collects as undesired residues at the bottom of the groove in the shaft 2. However, the presence of the pasty medium 8 at the bottom of the groove in the present invention effectively prevents penetration of the medium being mixed any distance into the joint. Thus, the presence of the pasty medium 8 at the base of the joint is advantageous regardless of its electrically conductive properties.

The pasty medium 8 itself is at least partially electrically conductive and preferably comprises a chemically universal non-corroding material in order that any material which penetrates into the connection joint does not cause any corrosion to occur that may destroy the joint. Also, it is important, that the medium 8 itself does not damage the regions of the drive shaft 2 and the blade assembly 6 with which it is in contact. In appropriate cases it can be made from one or more food grade materials.

Preferably, the pasty medium comprises a mixture of an electrically conductive material such as graphite, the ratio of graphite to the other materials of the medium being varied to achieve the desired conductivity. The graphite is included with a binding material such as low molecular weight polytetrafluoroethylene (PTFE) powder to form a paste. Such compositions, for example, range from about 25 to about 75 weight percent graphite and from about 75 to about 25 weight percent PTFE. The most preferred composition is about 50 weight percent graphite and about 50 weight percent PTFE.

It is to be understood that other binding materials can be used that are resistant to the particular corrosion and temperature conditions of use. Such materials can, for example, be polyethylene waxes, polyvinylchloride waxes and low molecular weight silicone polymers.

It is to be further understood that electrically conductive corrosion resistant powders in addition to or instead of graphite can be used. Such other corrosion resistant electrically conductive powders, for example, include platinum and palladium powders.

Other materials, such as fillers, may be added to the medium, as desired or required. For example it may comprise proprietary materials containing particular metal, ceramic or organic materials for identification purposes.

It will be appreciated that in order to ensure that cavities are not formed in the medium 8 during use of the agitator assembly, the medium 8 preferably has a coefficient of thermal expansion which is comparable with that of the components between which it is to be located. In most cases these components will be steel. Also, the medium 8 preferably has a viscosity which remains substantially constant over a temperature range between −90° C. and 300° C. inclusive.

To facilitate use of the medium 8, preferably it is also made with sufficient form stability to be plastically deformable and impermeable.

It will be appreciated that the method according to the invention provides an electrical connection between the components which has sufficient conductivity and which is simple and cost effective. There is no requirement for any external conductive connection between the components and the connection used is chemically stable.

The invention also has the advantage that existing components which are shrink-fitted together can be upgraded to incorporate the invention by being separated, modified in accordance with the invention, and then reassembled. It is also possible to test the electrical connection of two components nondestructively.

Whilst the invention has been described herein with particular reference to its application to an agitator assembly, it will be appreciated that it can be used to provide an electrical connection between any metallic components which have a non-conductive coating and are to be connected using a shrink/interference fitment or held by means such that the components are maintained in the same relative positions.

What is claimed is:

1. An electrically conductive connection between metallic components (2, 6) which have a non-conductive metal coating (7) wherein at least partially electrically conductive pasty medium (8) is located in a pocket (12) between the components (2, 6) in contact with metallic portions (9, 10) of the components (2, 6) which are substantially free of any non-conductive coating (7), the connection itself providing a protection against the pasty medium (8) being removed from the pocket (12) when the connection is in use.

2. A connection as claimed in claim 1, wherein the components (2, 6) are shrink-fitted together to form the connection, the pasty medium (8) being located within the area of contact between the components (2, 6) and surrounded by interference fitted contact areas (11) between the components (2, 6) to provide the protection for the pasty medium (8).

3. A connection as claimed in claim 2, wherein prior to the shrink-fitment of the components (2, 6) with one another, at least one of them has been provided with a pocket (12) in which a volume of the pasty medium (8) can be retained and within which the metallic portion (9, 10) that is substantially free of the non-conductive coating (7) is located.

4. A connection as claimed in claim 3, wherein the surface area of the pocket opening is large in comparison to the surface area of the metallic portion (9, 10) of the component (2, 6) located therein.

5. A connection as claimed in claim 3, wherein the surface area of the pocket (12) as presented to the other component is large in comparison to the surface area of the metallic portion (9, 10) of the other component (2, 6).

6. A connection as claimed in claim 4, wherein the surface area of the pocket (12) as presented to the other component is large in comparison to the surface area of the metallic portion (9, 10) of the other component (2, 6).

7. A connection as claimed in claim 3, wherein complementary pockets (12) are provided in the components (2, 6) in regions which will lie apposed to one another when the components (2, 6) have been shrink-fitted together.

8. A connection as claimed in claim 4, wherein complementary pockets (12) are provided in the components (2, 6) in regions which will lie apposed to one another when the components (2, 6) have been shrink-fitted together.

9. A connection as claimed in claim 3, wherein the pasty medium (8) completely fills the volume of the pocket or pockets (12) provided between the components (2, 6).

10. A connection as claimed in claim 5, wherein the pasty medium (8) completely fills the volume of the pocket or pockets (12) provided between the components (2, 6).

11. A connection as claimed in claim 7, wherein the pasty medium (8) completely fills the volume of the pocket or pockets (12) provided between the components (2, 6).

12. A connection as claimed in claim 9, wherein the pasty medium (8) completely fills the volume of the pocket or pockets (12) provided between the components (2, 6).

13. A connection as claimed in claim 2, wherein at least one of the components (2) comprises a groove, at least part (10) of the surface of which groove is substantially free of any non-conductive coating (7) to form the metallic portion (10) of the component (2), and in that the bottom of the groove is filled with the pasty medium (8) so that the metallic portion (10) is completely covered by the pasty medium (8).

14. A connection as claimed in claim 13, wherein sufficient pasty medium (8) is used to fill the groove so that penetration of an exterior medium into the shrink-fitted joint is substantially prevented.

15. A method of producing the electrically conductive connection of claim 2 between metallic components (2, 6) which have been provided with a non-conductive coating (7) wherein the method comprises the steps of:

treating the surface of at least one of the components (2, 6) in a region which will lie within an area of contact between the components (2, 6) when the two are shrink-fitted together to provide a pocket (12) and to provide a portion (9 or 10) within the pocket (12) which is substantially free of the non-conductive coating (7);

providing a portion (10 or 9) on the other of the components (6, 2) which is substantially free of the non-conductive coating (7) in a region which will lie apposed to the pocket (12) when the components have been shrink-fitted together;

filling the pocket (12) with the pasty medium (8);

smoothing the surface of the pasty medium (8); and shrink-fitting the components (2, 6) together.

16. A method as claimed in claim 15, wherein it comprises the additional steps of:

treating the surfaces of both of the components (2, 6) in regions which will lie apposed to one another when the two are shrink-fitted together to provide a pocket (12) in each component (2, 6); and filling both pockets (12) with the pasty medium (8) prior to the shrink fitment of the components (2, 6) together.

17. A connection as claimed in claim 10, wherein the surface of the pasty medium (8) in the pocket or pockets (12) is smoothed so as to stand lightly proud of the adjacent surfaces of the component (2, 6).

18. The connection of claim 1 wherein the electrically conductive pasty medium comprises a chemically universal non-corroding material.

19. The connection of claim 1 wherein the electrically conductive pasty medium is made from one or more food grade materials.

20. The connection of claim 1 wherein the electrically conductive pasty medium comprises graphite.

21. The connection of claim 1 wherein the electrically conductive pasty medium comprises graphite and the ratio of the graphite to other materials is varied to achieve a desired conductivity of the medium.

22. The connection of claim 1 wherein the electrically conductive pasty medium comprises materials for identification purposes.

23. The connection of claim 1 wherein the electrically conductive pasty medium has a viscosity which remains substantially constant over a temperature range between −90° C. and 300° C. inclusive.

24. The connection of claim 1 wherein the electrically conductive pasty medium has sufficient form stability to be plastically deformable in a temperature range between −90° C. and 300° C. inclusive.

25. The connection of claim 1 wherein the electrically conductive pasty medium is liquid and gas impermeable.

26. The connection of claim 1 wherein the electrically conductive pasty medium has a coefficient of thermal expansion which is comparable with that of the components (2, 6) between which it is to be located.

27. An electrically conductive connection between metallic components (2, 6) which have a non-conductive coating (7), wherein at least partially electrically conductive pasty medium (8) is located in a pocket (12) between the components (2, 6) in contact with metallic portions (9, 10) of the components (2, 6) which are substantially free of any non-conductive coating (7), the connection itself providing a protection against the pasty medium being removed from the pocket (12) when the connection is in use.

28. An agitator assembly (1) comprising at least two metallic components (2, 6) which have a non-conductive coating (7), wherein at least partially electrically conductive pasty medium (8) is located in a pocket (12) between a drive shaft (2) and a hub (5) of a blade assembly (6) of the agitator assembly (1) which pasty medium is in contact with metallic portions (9, 10) of the drive shaft (2) and the hub (5) which are substantially free of any non-conductive coating (7), the connection itself providing a protection against the pasty medium (8) being removed from the pocket (12) when the connection is in use.

* * * * *